US009534850B2

(12) United States Patent
Jekerle

(10) Patent No.: US 9,534,850 B2
(45) Date of Patent: Jan. 3, 2017

(54) TUBE BUNDLE HEAT EXCHANGER

(75) Inventor: Jiri Jekerle, Kassel (DE)

(73) Assignee: Arvos Technology Limited, Brugg (CH)

( * ) Notice: Subject to any disclaimer, the term of this patent is extended or adjusted under 35 U.S.C. 154(b) by 1274 days.

(21) Appl. No.: 12/087,444

(22) PCT Filed: Jan. 19, 2007

(86) PCT No.: PCT/DE2007/000089
§ 371 (c)(1),
(2), (4) Date: Jul. 3, 2008

(87) PCT Pub. No.: WO2007/082515
PCT Pub. Date: Jul. 26, 2007

(65) Prior Publication Data

US 2009/0065185 A1 Mar. 12, 2009

(30) Foreign Application Priority Data

Jan. 23, 2006 (DE) ..... 10 2006 003 317

(51) Int. Cl.
*F28F 9/18* (2006.01)
*F28D 7/16* (2006.01)
*F28D 7/10* (2006.01)
*F28F 1/00* (2006.01)

(52) U.S. Cl.
CPC ..... *F28D 7/16* (2013.01); *F28D 7/106* (2013.01); *F28F 9/182* (2013.01); *F28F 9/185* (2013.01); *F28F 1/006* (2013.01)

(58) Field of Classification Search
CPC ..... F28F 1/006; F28F 1/025; F28F 9/182
USPC ..... 165/178, 174
See application file for complete search history.

(56) References Cited

U.S. PATENT DOCUMENTS

| | | | | | |
|---|---|---|---|---|---|
| 1,429,149 | A | * | 9/1922 | Lawrence | 165/174 |
| 1,477,209 | A | * | 12/1923 | Cowan | 165/177 |
| 1,524,280 | A | * | 1/1925 | Bancel | 165/178 |
| 1,894,956 | A | * | 1/1933 | Kerr | 165/178 |
| 3,240,266 | A | * | 3/1966 | Corbet et al. | 165/178 |
| 3,317,222 | A | | 5/1967 | Maretzo | 285/55 |

(Continued)

FOREIGN PATENT DOCUMENTS

| | | |
|---|---|---|
| EP | 0 805 331 A2 | 11/1997 |
| EP | 1 154 143 A1 | 11/2001 |

(Continued)

*Primary Examiner* — Leonard R Leo
(74) *Attorney, Agent, or Firm* — MKG, LLC

(57) ABSTRACT

A tube bundle heat exchanger has tubes which are held at each side in tube plates or oval-tube collecting-tube plates and are connected to these in each case by means of a weld seam. The connection of the tubes to the inlet-side tube plate or oval-tube collecting-tube plate is formed in each case by means of a conical and/or trumpet-shaped transition piece. The cross section of the transition piece reduces as viewed in the gas flow direction in such a way that the inlet-side end, as viewed in the gas flow direction, of the transition piece is connected in a butt joint to the tube plate or oval-tube collecting-tube plate. The inner and outer contours of the transition piece and of the welded connection region are formed without gaps and corners to the tube plate or oval tube collecting-tube plate and so as to be straight and/or with a radius, measured from the outer contour, of at least 5 mm.

6 Claims, 5 Drawing Sheets

(56) References Cited

U.S. PATENT DOCUMENTS

| | | | | | |
|---|---|---|---|---|---|
| 3,452,814 | A * | 7/1969 | Malewicz | ..... | 165/178 |
| 3,540,529 | A * | 11/1970 | Umino et al. | ..... | 165/134.1 |
| 4,750,553 | A * | 6/1988 | Pohl et al. | ..... | 165/134.1 |
| 4,858,684 | A | 8/1989 | Brücher et al. | ..... | 165/134.1 |
| 5,101,892 | A | 4/1992 | Takeuchi et al. | ..... | 165/158 |
| 5,605,655 | A * | 2/1997 | Ishihara et al. | ..... | 261/116 |
| 7,347,351 | B2 * | 3/2008 | Slattery | ..... | 228/112.1 |
| 2007/0017664 | A1 * | 1/2007 | Beamer et al. | ..... | 165/178 |

FOREIGN PATENT DOCUMENTS

| | | | | |
|---|---|---|---|---|
| FR | 775.271 | 12/1934 | | |
| FR | 1.219.505 | 5/1960 | | |
| JP | 83112 | 9/1929 | | |
| JP | 93590 | 6/1987 | | |
| JP | 62-158996 | 7/1987 | | |
| JP | 158996 | 7/1987 | | |
| JP | 10328861 A * | 12/1998 | ..... | B23K 26/00 |

* cited by examiner

TUBE BUNDLE HEAT EXCHANGER

CROSS-REFERENCE TO RELATED APPLICATIONS

This is the national stage of International Application No. PCT/DE2007/000089, filed Jan. 19, 2007 and which designated the United States.

BACKGROUND

The invention relates to a tube bundle heat exchanger having tubes that are held at each side in tube plates or oval tube collecting tube plates and are connected to these in each case by means of a weld seam, for cooling, by means of a cooling medium surrounding the tubes, a hot gas flow that is directed through the tubes, exhibiting at least one gas inlet chamber, from which the hot gas flow is directed into the individual tubes and which is delimited at one side by the inlet-side tube plate or oval tube collecting tube plate, and at least one gas outlet chamber in which the gas flow directed through the tubes is collected and discharged and which is delimited on one side by the outlet-side tube plate or oval tube collecting tube plate.

As a rule, for cooling gases in many materials processing installations, such as, for example, gasification installations, thermal and catalytic splitting installations, steam reforming installations, etc., heat exchangers, in particular, tube bundle heat exchangers (coolers), are used, into which the gases to be cooled flow through straight tubes and thereby give off the latent heat of the hot gas through the tube wall to the medium surrounding the tubes, in particular, the cooling medium. It is characteristic of such heat exchangers that the gases to be cooled are often under high pressure and at a high temperature and enter the straight tubes of the heat exchanger at high speed. As a result, at the tube inlet or the first section of the tube, a high heat flow density is achieved, which causes both a high temperature as well as high thermal stress in the tubes of the heat exchanger or in the tube plate—tube connection.

In state of the art heat exchangers, the tubes that conduct the gas are welded into the tube plates, whereby the weld seam between tube plate and tube is applied either at the outer or inner wall of the tube plate or inside the tube plate opening. For example, printed document DE 37 15 713 C2 exhibits a welded connection of the tube or tubes with the outer wall of the tube plate or the oval tube collecting tube plate.

The disadvantage of this known design consists in the fact that the gas-facing contour or surface of the transition from the tube to the tube plate or the oval tube collecting tube plate does not exhibit an exactly aerodynamic form. As a rule, the use of an inserted sleeve is undesirable for a number of different reasons, among them a narrowing of the gas-side cross section as well as an inadequate cooling of the sleeve. In addition, a gap can appear on the cooling medium side of the tube plates—tube connection, leading to water-side corrosion, or the tube plates—tube connection can exhibit a corner in which an unwanted stress concentration occurs.

Through document EP 1 154 143 A1, a cooler has become known in whose heat exchanger tubes, which lie between an inlet-side tube plate and an outlet-side tube plate, an exhaust gas is cooled by cooling water. Through the cooling of the exhaust gas, a condensate that exhibits a corrosive component is created, which causes corrosion at the connection of the particular tube with the outlet-side tube plate. As a result of this corrosion, a leak of the cooling water occurs at this connection, which leads to damage of the downstream machine. To prevent the leak, it is suggested that the connection of the particular tube with the outlet-side tube plate be designed in such a way that the tube is placed through the tube plate in a conical manner and the conical part of the tube is completely laser welded to the tube plate in order to achieve a deep-reaching welded connection.

SUMMARY

The task of the present invention consists in creating a tube bundle heat exchanger in which the disadvantages cited above can be avoided, and the transition from the tube plate or oval tube collecting tube plate to the tubes on the gas side exhibits a contour that is favorable to flow and no disturbing elements are present on the cooling medium side and the gas side.

The solution provides that the connection of the tubes with the inlet-side tube plate or oval header tube sheet is formed in each case by means of a conical and/or trumpet-shaped transition piece whose cross section reduces, as viewed in the gas flow direction, in such a way that the inlet-side end, as viewed in the gas flow direction, of the transition piece is connected in the manner of a butt joint to the tube plate or oval header tube sheet, and the inner and outer contours of the transition piece and of the welded connection region are formed without gaps and corners to the tube plate or oval header tube sheet, and so as to be straight and/or with a radius, measured from the outer contour, that is equal to or greater than 5 mm.

Through the solution according to the invention, a tube bundle heat exchanger is created that exhibits the following advantages:

- By avoiding the protruding corners and gaps at the connecting location between the tubes and the tube plate or the oval tube collecting tube plate, first, turbulence of the gas and the cooling medium is prevented, and second, corrosion is eliminated,
- The transition from the tube plate or the oval tube collecting tube plate to the tubes is designed aerodynamically, so that the entry of the gas into the tubes runs to the greatest extent turbulence-free, and temperature peaks in the inlet region can be reduced.

In an advantageous further development, the length Lü of the transition piece is at least 1.5 times the inside diameter di of the heat exchanger tube and/or the inside diameter Di of the transition piece at its inlet is at least 1.2 times the inside diameter di of the heat exchanger tube in order to achieve an optimized aerodynamic transition of the tube plate or the oval tube collecting tube plate to the particular heat exchanger tubes.

It is useful to mechanically widen the transition piece at the inlet-side end of the tube, as viewed in the gas flow direction. Through this measure, only one part—the tube—is fabricated, and the work process for the manufacture of the transition piece according to the invention can be simplified and shortened.

In an advantageous further development of the invention, the transition piece is formed from a separate tube part, and the outlet-side end, as viewed in the gas flow direction, of the transition piece is connected in the manner of a butt joint with the tube by means of weld seam. Through the use of a separate tube part, even transition pieces that are complicated in their form (for example, various differing transition radii) can be manufactured in a substantially simpler and less expensive way. In this further development of the invention, it is useful to form the inner and outer contours of the welded connection region between the transition piece and the tube without gaps and corners and so as to be straight and/or with a radius equal to or greater than 5 mm. Through this measure, an aerodynamic form is achieved at the inlet of the gas into the tube.

In an especially advantageous manner, the inner and outer contours of the transition piece and of the welded connection region to the tube plate or the oval tube collecting tube plate and to the tube are formed without gaps and corners, and so as to be straight and/or with a radius equal to or greater than 2 mm.

The tube part that is used as the transition piece is usefully formed as a forged piece.

BRIEF DESCRIPTION OF THE DRAWINGS

In the following, embodiments of the invention are explained in more detail with the aid of the drawing and the description.

The following are shown.

DETAILED DESCRIPTION

Figure 1:
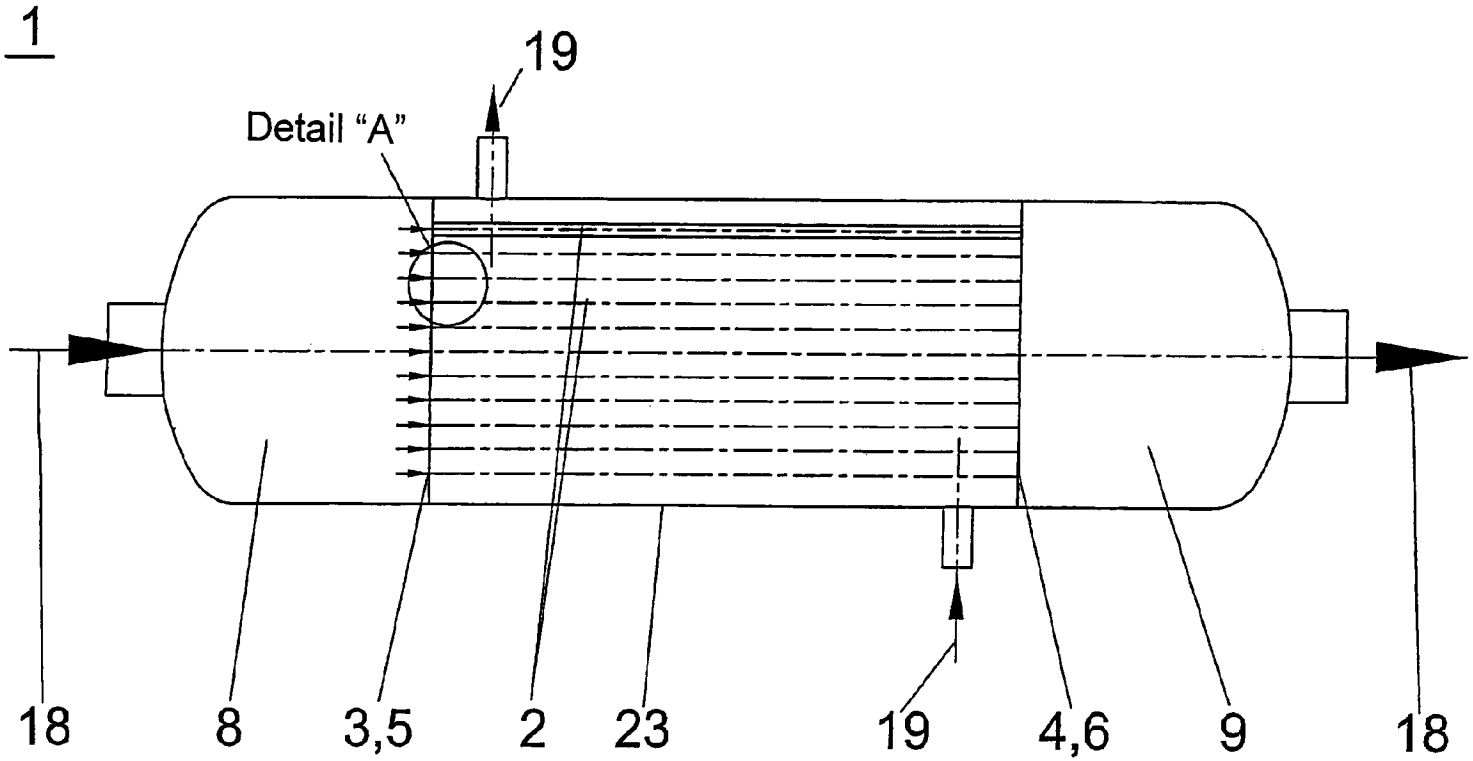
FIG. 1 a longitudinal section through a tube bundle heat exchanger.

FIG. 1 shows a tube bundle heat exchanger 1 represented schematically in longitudinal section. Tube bundle heat exchangers 1 of this type are needed in many material processing installations, such as, for example, gasification installations, thermal and catalytic splitting installations, steam reforming installations, etc., in which a process gas, an exhaust gas or something similar is produced. As a rule, the tube bundle heat exchanger 1 is used for cooling the hot gas 18 mentioned above, which is introduced into the gas inlet chamber 8 of the heat exchanger 1 via a line, not shown, and is directed from here through a multiplicity of straight tubes 2, subsequently collected in the gas outlet chamber 9 of the heat exchanger 1 and discharged from the heat exchanger 1 by means of a line, not shown. In that regard, the tubes 2, by means of which an indirect heat exchange with a cooling medium 19 surrounding the tubes 2 takes place, are arranged at a distance from each other between two tube plates 3, 4 or oval tube collecting tube plates 5, 6 and are connected with the latter in fixed and gas-tight—usually welded—fashion.

In order to keep the thermal stresses taking place at the entry of the hot gas 18 from the gas inlet chamber 8 into the particular heat exchanger tubes 2 at the inlet-side, as viewed in the gas flow direction, tube plates 3, 5 and the inlet-side ends 16 of the tubes 2 as small as possible, according to the invention the connection of the tubes 2 with the inlet-side tube plate 3 (see FIGS. 2 through 4) or oval tube collecting tube plate 5 (see FIG. 5) is formed in each case by means of a conical and/or trumpet-shaped transition piece 10 whose cross section decreases as viewed in the gas flow direction (see arrow). Moreover, the inlet-side end 16, as viewed in the gas flow direction, of the transition piece 10 is connected in the manner of a butt joint to the tube plate 3 or oval tube collecting tube plate 5, and the inner and outer contours 11, 12 of the transition piece 10 and of the welded connection region 13 are formed without gaps and corners to the tube plate 3 or oval tube collecting tube plate 5, and so as to be straight and/or with a radius, measured from the outer contour 12, of at least 5 mm.

This means that the inventive design of the transition from the tube plate 3 or the oval tube collecting tube plate 5 to the tube 2 creates an aerodynamic contour 11, 12 on both the gas-contacted and cooling medium-contacted side of the tube 2, of the transition piece 10 and of the tube plate 3 or oval tube collecting tube plate 5, which does not exhibit a gap, a corner or an angular transition anywhere. This means that according to the invention, all of the transitions, including that of the welded transition region 13 to the inner or outer contour 11, 12, are either straight or flat, and/or are designed with a radius.

Figure 2:
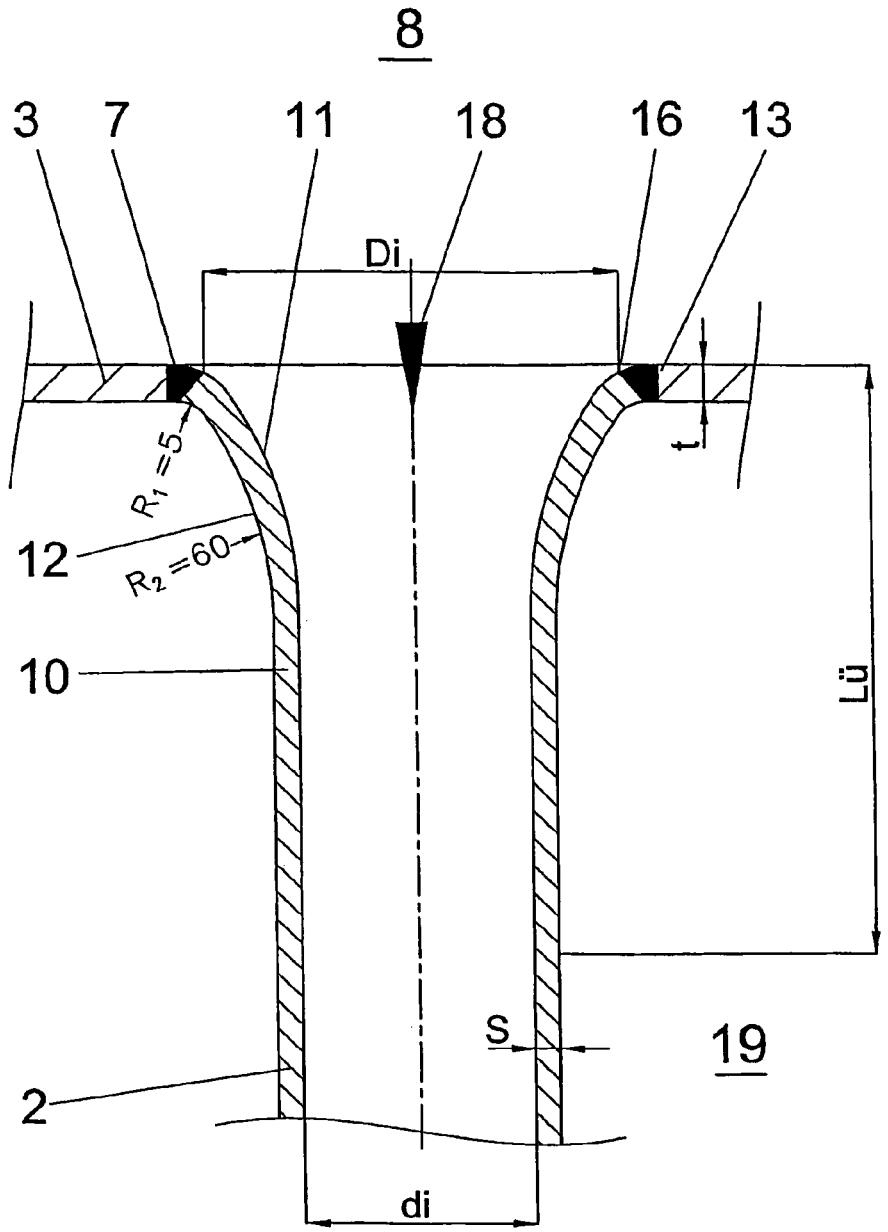
FIG. 2 a detail section of the transition from the tube plate to the tube in accordance with detail "A" from FIG. 1, FIG. 3 as FIG. 2, but an alternative design, FIG. 4 as FIG. 2, but an alternative design, FIG. 5 a detail section of the transition of an oval tube collecting tube plate to a tube.
Figure 3:
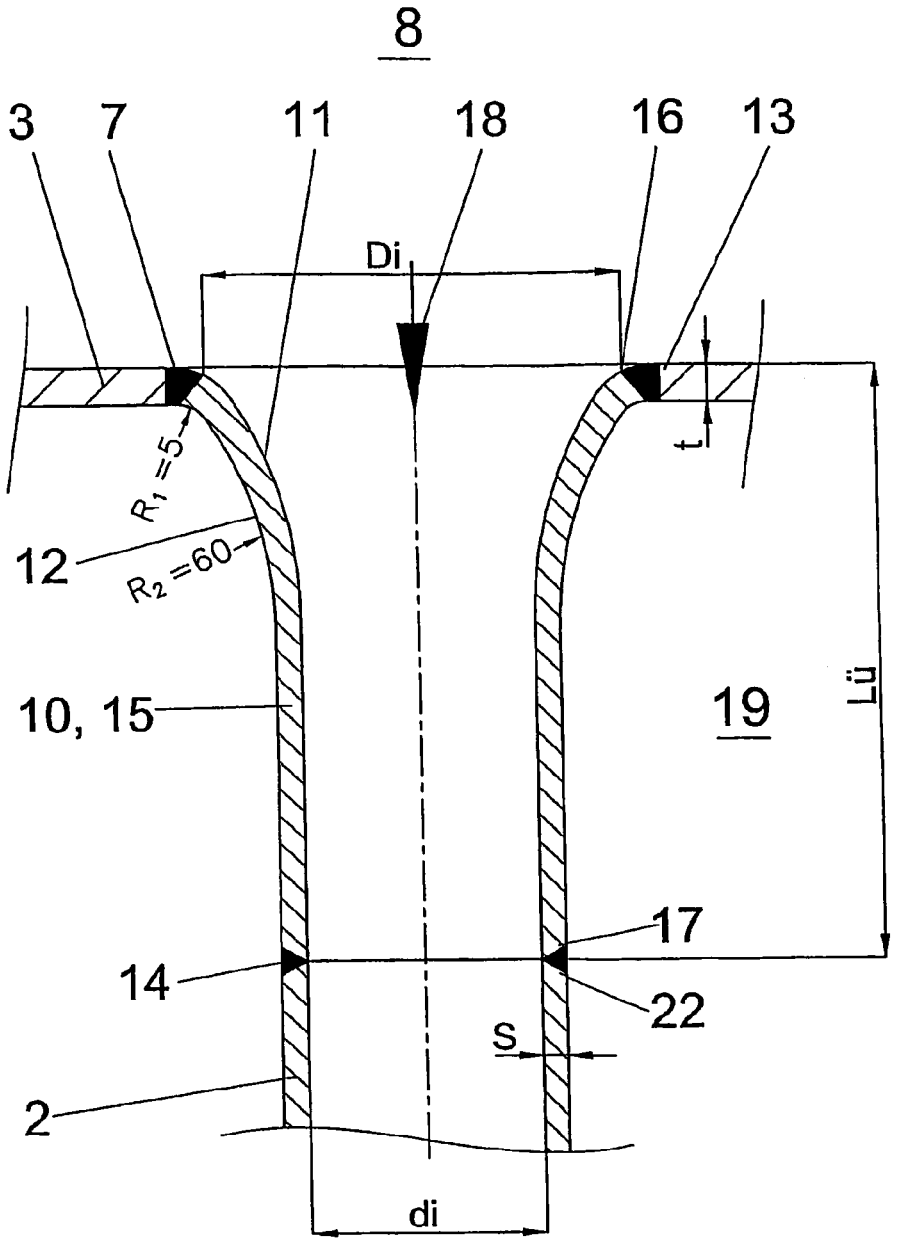
Figure 4:
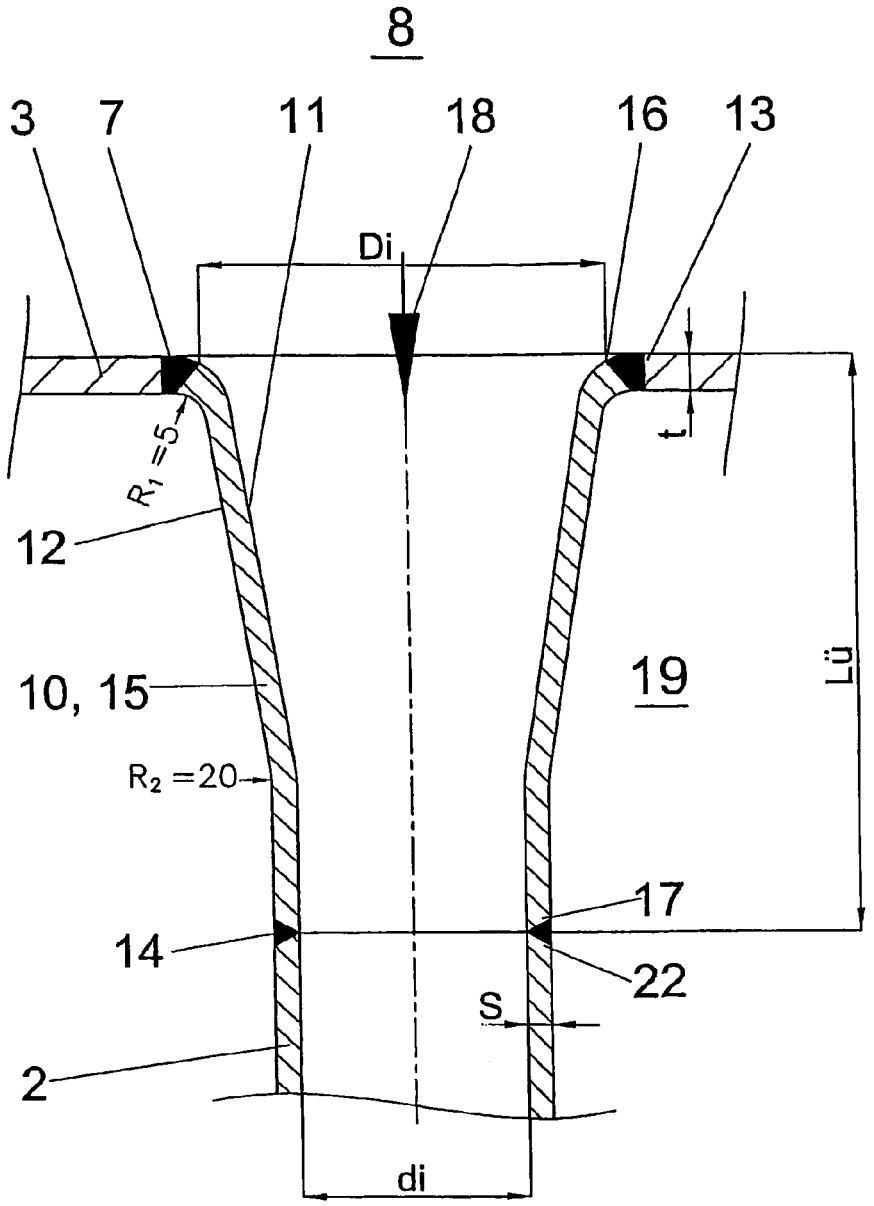
Figure 5:
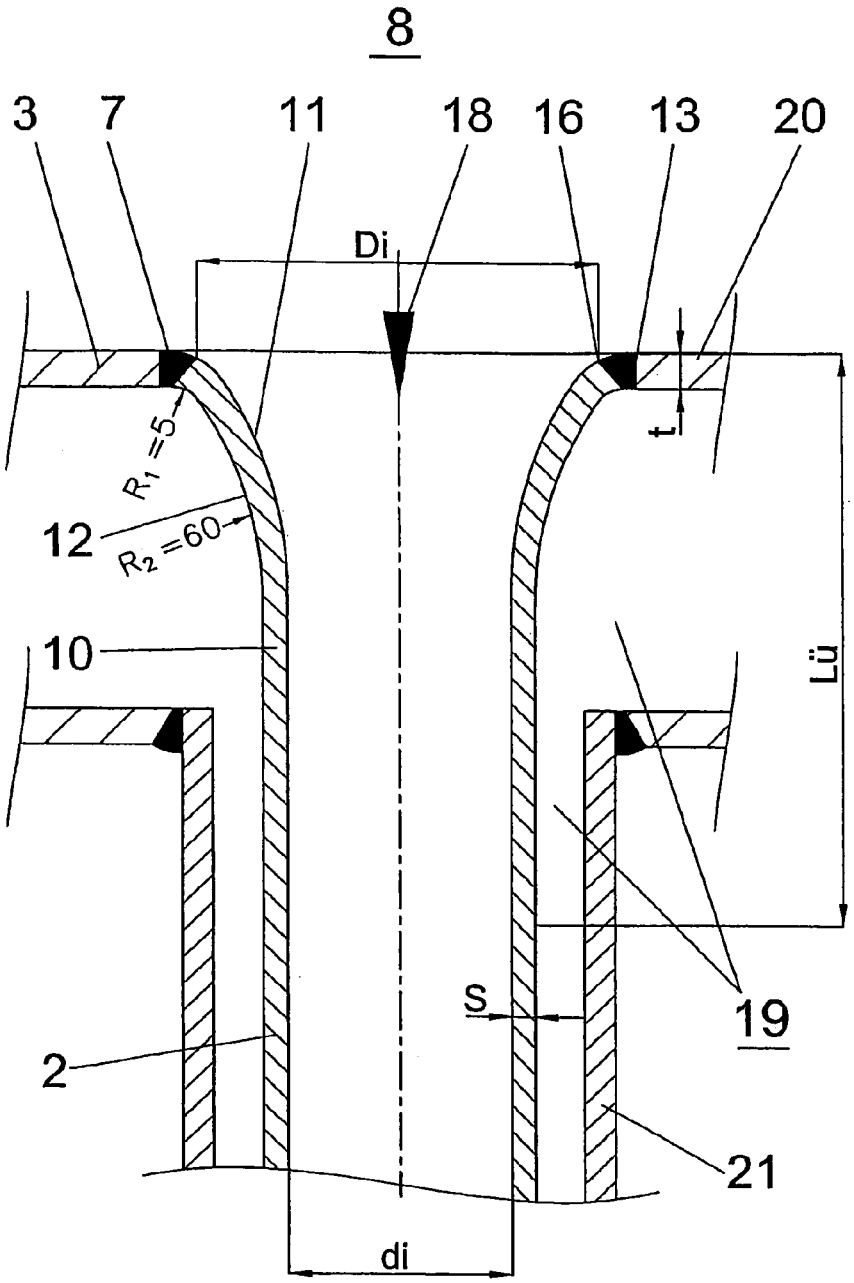

According to FIGS. 2 and 5, the transition piece 10 is the widened, e.g. mechanically, from the tube 2 at diameter di transitioning to diameter Di at the inlet end 16 of tube 2. In this design, only weld seam 7 is needed between the tube 2 and the tube plate 3 or 5, which forms the welded connection region 13 between the tube 2 and the tube plate 3, 5. FIGS. 3 and 4 show a transition piece 10 that consists of a separate tube part 15 and is as a rule easier to manufacture, since the tube part 15 is significantly shorter than the complete tube 2 and is thus easier to process as well. For the head-side connection of the outlet-side end 17, as viewed in the gas flow direction, of the tube part 15, an additional weld seam 22 is needed, which forms the welded connection region 14 between the tube 2 and the tube part 15. This welded connection region 14 is advantageously made either straight or flat and/or with a radius both on the inside as well as on the outside contour 11, 12, i.e., the region 14 is made without corners and gaps.

The transition pieces 10 according to FIGS. 2 through 5 exhibit on their inlet-side end 16, relative to the outer contour 12 of the transition pieces 10, a radius $R_1$ of 5 mm, for example. According to FIGS. 2, 3 and 5, adjoining that is an additional radius $R_2$ of 60 mm, for example, whereas by contrast in the case of the transition piece 10 according to FIG. 4, adjoining the first radius is a conical contraction with an adjoining radius of 20 mm, for example. The inside contour 11 of the transition pieces 10 according to FIGS. 2 and 5 then exhibits corresponding radii that are greater by the wall thickness s of the transition piece 10. If the wall thickness t of the tube plate 3, 5 does not correspond to the wall thickness s of the tube 2, then according to the invention the transition between the two wall thickness s and t within the welded connection region 13 is designed according to the invention either straight or flat and/or with a radius. A wall thickness t of the tube plates 3, 5 that differs from the wall thickness s of the tube 2 can be compensated according to FIGS. 3 and 4 with a transition piece 10 designed as a tube part 15, in that the particular wall thickness at the tube ends of the tube part 15 are adjusted to the wall thicknesses t and s of the tube plate 3, 5 as well as of the tube 2. This means that, viewed in the gas flow direction, inside the tube piece 15 the wall thickness t continuously decreases or increases to the wall thickness s. In that regard, the tube part 15 can advantageously be designed as a forged part.

The length Lü of the transition piece 10 is advantageously 1.5 times the inside diameter di of the tube 2 and the inside diameter Di of the transition piece 10 directly at the entry into the transition piece 10 is advantageously 1.2 times the inside diameter di of the tube 2.

By way of example, FIG. 4 shows in place of the trumpet-shaped transition piece 10 a conical transition piece 10, which is also formed from a separate tube part 15. Here again, the tube part 15 is connected with the tube plate 3 and the tube 2 by two weld seams 7, 22.

FIG. 5 shows a tube bundle heat exchanger 1 with double tubes 2, 21 in which the cooling medium 19 circulates in the annular cross section between the inner tube 2 and the outer tube 21. Because of the outer tubes 21 that carry the cooling medium 19, the heat exchanger outer jacket 23, which is shown in FIG. 1 and which would otherwise be required, can be dispensed with. While in the case of the heat exchanger 1 shown in FIG. 1, the cooling medium 19 is fed to and discharged from the space inside the outer jacket 23 and the tube plates 3, 5 and 4, 6, according to FIG. 5 the cooling medium 19 is fed and discharged by means of oval tube collector 20. In this case, the connection of the transition piece 10 according to the invention takes place with the oval tube collecting tube plate 5.

Water that is partially or completely vaporized by the addition of heat can be used as the cooling medium 19.

LIST OF REFERENCE SYMBOLS

1 Tube bundle heat exchanger
2 Tube
3 Tube plate, inlet side,
4 Tube plate, outlet side
5 Oval tube collecting tube plate, inlet side
6 Oval tube collecting tube plate, outlet side
7 Weld seam
8 Gas inlet chamber
9 Gas outlet chamber
10 Transition piece
11 Inside contour
12 Outside contour
13 Welded connection region
14 Welded connection region
15 Tube part
16 Inlet-side end of the transition piece or of the tube
17 Outlet-side end of the transition piece or of the tube
18 Gas
19 Cooling medium
20 Oval tube collector
21 Outer tube
22 Weld seam
23 Jacket

The invention claimed is:

1. A tube bundle heat exchanger comprising:

a gas inlet chamber adapted to receive a gas into the heat exchanger; a gas outlet chamber adapted to emit the gas from the heat exchanger; an inlet-side tube plate disposed proximate to the gas inlet chamber having a plurality of openings;

an outlet-side tube plate disposed proximate to the gas outlet chamber having a plurality of openings;

a plurality of tubes, each of the tubes having an inlet end and an outlet end, wherein the inlet end of each tube is welded to a respective opening of the inlet-side tube plate and the outlet end of each tube is welded to a respective opening of the outlet-side tube plate to provide fluid communication of the gas between the gas inlet chamber and the gas outlet chamber, a transition piece extending from each tube and terminating at the tube inlet end of each tube, the transition piece having an aerodynamic inner contour expanding outwardly to the respective opening of the inlet-side tube plate to provide a generally trumpet-shaped inner contour that transitions into the respective opening of the inlet-side tube plate at the inlet end, and the transition piece having an aerodynamic outer contour expanding outwardly to the respective opening of the inlet-side tube plate to provide the generally trumpet-shaped outer contour that transitions into the respective opening of the inlet-side tube plate at the inlet end;

the inner contour and the outer contour of the transition piece being formed without gaps or comers to the inlet-side tube plate; and wherein a first portion of the outer contour defines an outer edge that has a first radius and a second portion of the outer contour has a second radius, the first radius being less than the second radius, wherein the first radius is at least 5 mm and the second radius is approximately 60 mm.

2. The tube bundle heat exchanger of claim 1, wherein each of the tubes has an inside diameter and a transition portion defined by an outer edge and a straight portion of the tube, the transition portion having a length that is at least 1.5 times the inside diameter of the straight portion of the tube.

3. The tube bundle heat exchanger of claim 1, wherein a straight portion of each of the tubes has a first inside diameter and an outer edge of the inlet end has a second inside diameter, the second inside diameter being at least 1.2 times the first inside diameter.

4. The tube bundle heat exchanger of claim 1, wherein the inlet end is integral with a straight portion of the tube.

5. The tube bundle heat exchanger of claim 1, further comprising an outer shell dispose around the plurality of tubes, the outer shell having a fluid inlet for receiving a heat transfer medium and a fluid outlet to exiting the heat transfer medium, wherein the heat transfer medium enters the fluid inlet, passes through the plurality of tubes to exchange heat between the medium and the gas passing through the tubes, and exits through the fluid outlet.

6. The tube bundle heat exchanger of claim 1, wherein an outer edge has a first radius and the inner contour has a second radius, the first radius being less than the second radius.

* * * * *